US010214346B2

(12) United States Patent
Weyna et al.

(10) Patent No.: US 10,214,346 B2
(45) Date of Patent: Feb. 26, 2019

(54) APPARATUS AND METHOD FOR MONITORING CARGO CONDITIONS

(71) Applicant: Carrier Corporation, Farmington, CT (US)

(72) Inventors: Paul V. Weyna, Manlius, NY (US); Malcolm N. Fleming, Jr., Syracuse, NY (US)

(73) Assignee: CARRIER CORPORATION, Farmington, CT (US)

( * ) Notice: Subject to any disclaimer, the term of this patent is extended or adjusted under 35 U.S.C. 154(b) by 0 days.

(21) Appl. No.: 15/551,698

(22) PCT Filed: Feb. 18, 2016

(86) PCT No.: PCT/US2016/018390

§ 371 (c)(1),
(2) Date: Aug. 17, 2017

(87) PCT Pub. No.: WO2016/134100

PCT Pub. Date: Aug. 25, 2016

(65) Prior Publication Data

US 2018/0022540 A1 Jan. 25, 2018

Related U.S. Application Data

(60) Provisional application No. 62/117,504, filed on Feb. 18, 2015.

(51) Int. Cl.

| | |
|---|---|
| ***B65D 90/48*** | (2006.01) |
| ***F25D 29/00*** | (2006.01) |
| *B65D 88/74* | (2006.01) |

(52) U.S. Cl.

CPC ..... *B65D 90/48* (2013.01); *F25D 29/003* (2013.01); *B65D 88/745* (2013.01); *F25D 29/005* (2013.01); *F25D 2700/16* (2013.01)

(58) Field of Classification Search

CPC ..... B65D 90/48; B65D 88/745; F25D 29/003; F25D 2700/16; F25D 29/005

See application file for complete search history.

(56) References Cited

U.S. PATENT DOCUMENTS

| | | | | |
|---|---|---|---|---|
| 5,170,605 | A | 12/1992 | Huddle | |
| 6,089,110 | A | 7/2000 | Pallotta et al. | |
| 6,742,349 | B1 | 6/2004 | Kawai et al. | |
| 6,901,971 | B2 | 6/2005 | Speasl et al. | |
| 8,334,781 | B2 | 12/2012 | Heck et al. | |
| 8,881,540 | B1 * | 11/2014 | Barakat | F25D 3/06 414/222.02 |

(Continued)

FOREIGN PATENT DOCUMENTS

| | | | |
|---|---|---|---|
| CN | 101443634 | A | 5/2009 |
| CN | 101813703 | A | 8/2010 |

(Continued)

OTHER PUBLICATIONS

International Search Report and Written Opinion for application PCT/US2016/018390, dated May 2, 2016, 12pgs.

(Continued)

*Primary Examiner* — Erin F Heard
(74) *Attorney, Agent, or Firm* — Cantor Colburn LLP

(57) ABSTRACT

A method and system for monitoring cargo conditions, includes at least one environmental sensor (50) to monitor at least one environmental parameter associated with the cargo (30), a controller (60) to log a plurality of readings from each of the at least one environmental sensors (50), and a sensor interface (51) to facilitate communication between the at least one environmental sensor (50) and the controller (60).

11 Claims, 4 Drawing Sheets

(56) References Cited

U.S. PATENT DOCUMENTS

| | | | | |
|---|---|---|---|---|
| 2007/0267509 | A1 | 11/2007 | Witty et al. | |
| 2010/0287963 | A1 | 11/2010 | Billen et al. | |
| 2010/0299278 | A1* | 11/2010 | Kriss | G06Q 10/08 705/332 |
| 2011/0193710 | A1 | 8/2011 | McIlvain et al. | |
| 2011/0221573 | A1 | 9/2011 | Huat | |
| 2012/0111044 | A1 | 5/2012 | Chen et al. | |
| 2012/0233384 | A1* | 9/2012 | Charles | F15B 11/0365 711/103 |
| 2013/0247594 | A1 | 9/2013 | Sanders et al. | |
| 2013/0252552 | A1 | 9/2013 | Vitkus et al. | |
| 2014/0313055 | A1 | 10/2014 | Warkentin et al. | |
| 2015/0120597 | A1* | 4/2015 | Dertadian | F25D 31/006 705/332 |

FOREIGN PATENT DOCUMENTS

| | | | |
|---|---|---|---|
| CN | 102867199 | A | 1/2013 |
| DE | 102010035959 | A1 | 3/2012 |
| JP | H09207649 | A | 8/1997 |
| WO | 2009073034 | A1 | 6/2009 |
| WO | 2014053195 | A1 | 4/2014 |

OTHER PUBLICATIONS

Singpore Search Report and Written Opinion for application SG 11201706053R, dated Jun. 25, 2018, 8 pages.

Chinese First Office Action and Search Report for application CN 201680011182.X, dated Oct. 12, 2018, 9 pages.

* cited by examiner

APPARATUS AND METHOD FOR MONITORING CARGO CONDITIONS

FIELD OF THE INVENTION

The subject matter disclosed herein relates to facilitating sensor communication, and to a system and a method for facilitating sensor communication via a sensor interface.

DESCRIPTION OF RELATED ART

Typically, climate controlled containers are used to transport and distribute temperature sensitive and perishable goods. For example, food and pharmaceuticals may be susceptible to temperature, humidity, and other environmental factors. Advantageously, climate controlled containers allow perishable and environmentally sensitive goods to be effectively transported and distributed without damage or other undesirable effects.

Environmental parameter sensors are often used in climate controlled containers to monitor the conditions and integrity of the cargo transported. Additionally, certain organizations, such as the USDA, require certain environmental parameters such as temperature, to be monitored during transportation. Current environmental parameter sensor interfaces often require long cables to be connected to a central controller for recording data, often requiring significant routing and setup time, while leaving the cables and sensors susceptible to damage and costly replacements. A system and method that can provide a sensor interface without the previous disadvantages is desired.

BRIEF SUMMARY

According to an embodiment of the invention, an apparatus for monitoring cargo conditions, includes at least one environmental sensor to monitor at least one environmental parameter associated with the cargo, a controller to log a plurality of readings from each of the at least one environmental sensors, and a sensor interface to facilitate communication between the at least one environmental sensor and the controller.

In addition to one or more of the features described above, or as an alternative, further embodiments could include that the sensor interface is associated with a shipping container.

In addition to one or more of the features described above, or as an alternative, further embodiments could include that the at least one environmental parameter includes at least one of a temperature, a humidity, an ethylene level, and a carbon dioxide level.

In addition to one or more of the features described above, or as an alternative, further embodiments could include that the sensor interface is a wired sensor interface.

In addition to one or more of the features described above, or as an alternative, further embodiments could include that the sensor interface includes an embedded interface portion associated with the shipping container and a temporary interface portion associated with the at least one environmental sensor.

In addition to one or more of the features described above, or as an alternative, further embodiments could include that the sensor interface includes at least one plug termination associated with the embedded interface portion and the temporary interface portion.

In addition to one or more of the features described above, or as an alternative, further embodiments could include that the at least one plug termination is disposed on or in a floor or a ceiling of the shipping container.

In addition to one or more of the features described above, or as an alternative, further embodiments could include that the at least one plug termination is disposed on or in a wall of the shipping container.

In addition to one or more of the features described above, or as an alternative, further embodiments could include that the sensor interface is a wireless sensor interface and the at least one environmental sensors are wireless environmental sensors.

According to an embodiment of the invention, a method for monitoring cargo conditions, includes providing at least one environmental sensor, monitoring at least one environmental parameter via the at least one environmental sensor, logging a plurality of readings from each of the at least one environmental sensors via a controller, communicating between the at least one environmental sensor and the controller via a sensor interface.

In addition to one or more of the features described above, or as an alternative, further embodiments could include that the sensor interface is associated with a shipping container.

In addition to one or more of the features described above, or as an alternative, further embodiments could include that the sensor interface is a wired sensor interface.

In addition to one or more of the features described above, or as an alternative, further embodiments could include that the sensor interface includes an embedded interface portion associated with the shipping container, a temporary interface portion associated with the at least one environmental sensor, and at least one plug termination associated with the embedded interface portion and the temporary interface portion, the at least one plug termination is disposed on or in a floor or a ceiling of the shipping container.

In addition to one or more of the features described above, or as an alternative, further embodiments could include that the sensor interface includes an embedded interface portion associated with the shipping container, a temporary interface portion associated with the at least one environmental sensor, and at least one plug termination associated with the embedded interface portion and the temporary interface portion, the at least one plug termination is disposed on or in a wall of the shipping container.

In addition to one or more of the features described above, or as an alternative, further embodiments could include that the sensor interface is a wireless sensor interface and the at least one environmental sensors are wireless environmental sensors.

Technical function of the embodiments described above includes a sensor interface to facilitate communication between the at least one environmental sensor and the controller.

Other aspects, features, and techniques of the invention will become more apparent from the following description taken in conjunction with the drawings.

BRIEF DESCRIPTION OF THE SEVERAL VIEWS OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which like elements are numbered alike in the several FIGURES:

DETAILED DESCRIPTION OF THE INVENTION

Figure 1:
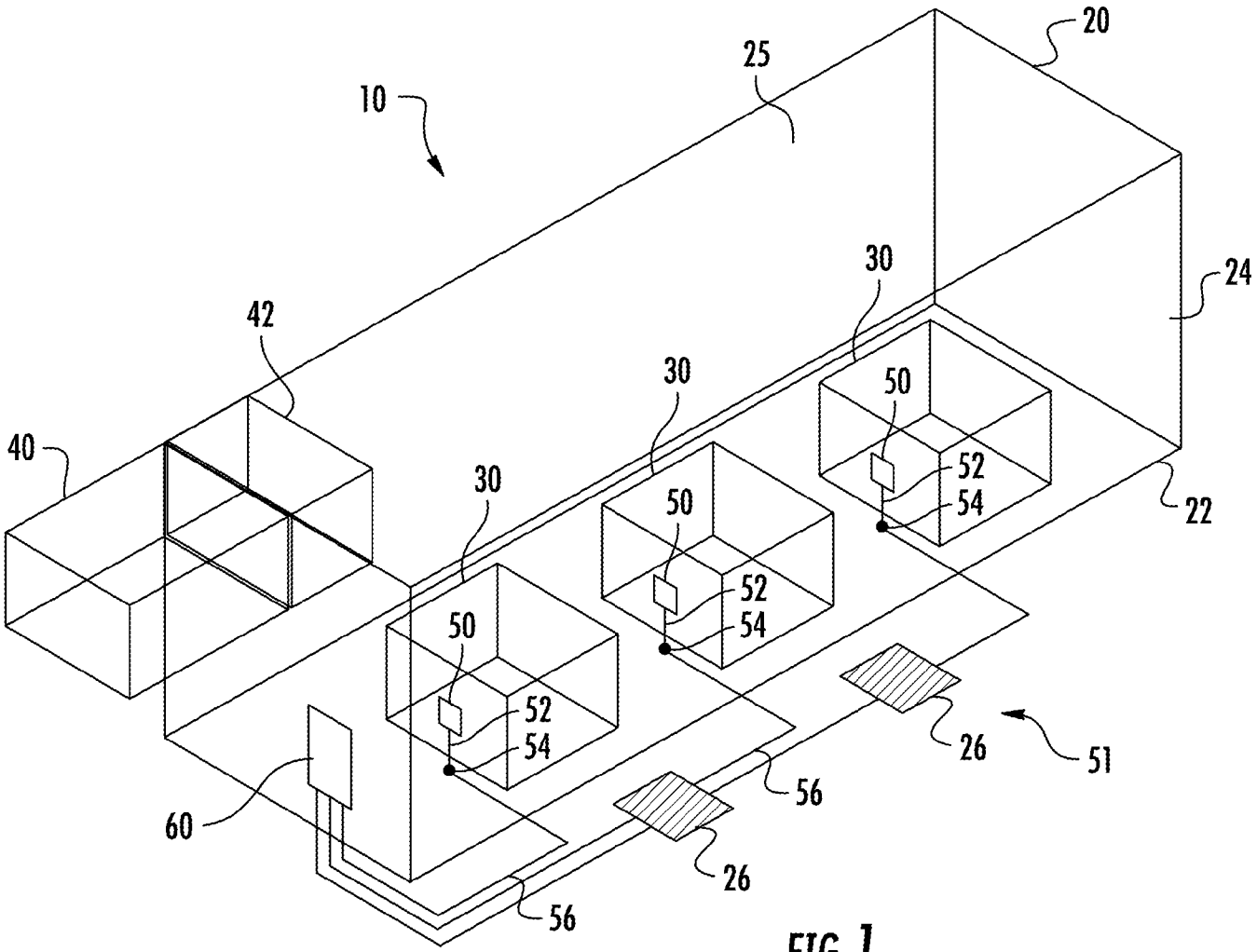
FIG. 1 illustrates a schematic view of an exemplary sensor interface in accordance with an embodiment of the invention.

Referring now to the drawings, FIG. 1 illustrates a schematic view of an exemplary climate controlled container suitable for use with a sensor interface. In an exemplary embodiment, cargo transportation system 10 includes a shipping container 20 containing cargo 30, with sensors 50 associated with the cargo 30, with sensor 50 data received by controller 60 via sensor interface 51.

In an exemplary embodiment, shipping container 20 is a climate controlled container that allows for transportation of cargo 30 by ship, rail, truck or any other suitable method of transportation. The shipping container 20 includes a floor 22 and walls 24. In an exemplary embodiment, floor 22 is a T-bar floor to facilitate the movement and securing of cargo 30. In certain embodiments, shipping container 20 includes conduit 26 to allow portions of sensor interface 51 to be disposed therein. Conduit 26 may be disposed within the cavities formed within T-bar floor 22. In certain embodiments, sensor interface 51 can be integrated with shipping container 20 during construction, while in other embodiments sensor interface 51 can be installed after construction. Sensor interface 51 can additionally be utilized in any other suitable application.

In an exemplary embodiment, shipping container 20 is associated with an air conditioner 40. Air conditioner 40 can provide climate control functions, such as regulating temperature, regulating humidity, etc. In certain embodiments, air conditioner evaporator 42 is located within the volume of shipping container 20.

In an exemplary embodiment, shipping container 20 can contain and transport cargo 30. Cargo 30 can include boxes, pallets, etc. In an exemplary embodiment, cargo 30 can include perishable cargo such as fruits, vegetables, drugs, blood, etc. Further, regulatory organizations, such as the USDA may require that certain cargo 30 is monitored for certain parameters, including, but not limited to temperature, humidity, gas levels, etc. to ensure compliance with prescribed guidelines.

In an exemplary embodiment, environmental sensors 50 are associated with cargo 30 to monitor desired parameters. Environmental parameters may include position data, humidity, time, temperature, shock, vibration, ambient light, and gas emissions (such as carbon dioxide and ethylene). Advantageously, environmental sensors 50 may be selected for certain applications depending on the cargo 30 to be monitored and the corresponding environmental sensitivities.

In an exemplary embodiment, readings from environmental sensors 50 are received by controller 60. In an exemplary embodiment, readings from environmental sensors 50 are received and processed by the controller 60. In an exemplary embodiment, readings from environmental sensors 50 are received and logged in memory during a desired monitoring period. In certain embodiments, the readings are further augmented with time, position stamps or other relevant information. In certain embodiments, controller 60 allows for further suitable analysis of readings from environmental sensors 50 to be performed.

In an exemplary embodiment, sensor interface 51 facilitates communication between environmental sensor 50 and controller 60. Advantageously, the use of sensor interface 51 reduces cable length associated with environmental sensors 50 exposed within container 20, reducing damage to cables, environmental sensors 50, and setup time. In an exemplary embodiment, sensor interface 51 includes a temporary interface portion 52, a plug termination 54, and an embedded interface portion 56.

In an exemplary embodiment, temporary interface portion 52 of sensor interface 51 is an exposed cable associated with an environmental sensor 50 at one end. In certain embodiments, the length of temporary interface portion 52 is minimized to prevent damage, minimize costs, and reduce setup time. At an opposite end, temporary interface portion 52 may be configured to associate with plug termination 54. In an exemplary embodiment, plug termination 54 allows for temporary interface portion 52 to connect with an embedded interface portion 56 of the sensor interface 51. In certain embodiments, temporary interface portion 52 is a retractable cable or interface to allow the temporary interface portion 52 to be extended to a desired length as required and retracted when the temporary interface portion 52 is not in use.

Plug termination 54 allows for a releasable connection with temporary interface portion 52. In an exemplary embodiment, plug terminations 54 are disposed in or on the floor 24 of shipping container 20. In certain embodiments, the plug terminations 54 are disposed at specific distances to facilitate ease of installation of temporary interface portion 52 and the associated environmental sensor 50, while reducing exposure to damage. Advantageously, the locations of plug terminations 54 may reduce the exposed length of temporary interface portion 52.

In an exemplary embodiment, embedded interface portion 56 is associated with the plug terminations 54. In certain embodiments, embedded interface portions 56 are disposed within the structure of the shipping container 20. In certain embodiments, the embedded interface portion 56 is disposed within or underneath the floor 22 of the shipping container 20. In certain embodiments, the embedded interface portion 56 is disposed within conduit 26. Advantageously, the embedded interface portion 56 is not exposed to damage, and is easily accessed via plug terminations 54, facilitating reuse of the embedded interface portion 56.

Figure 2:
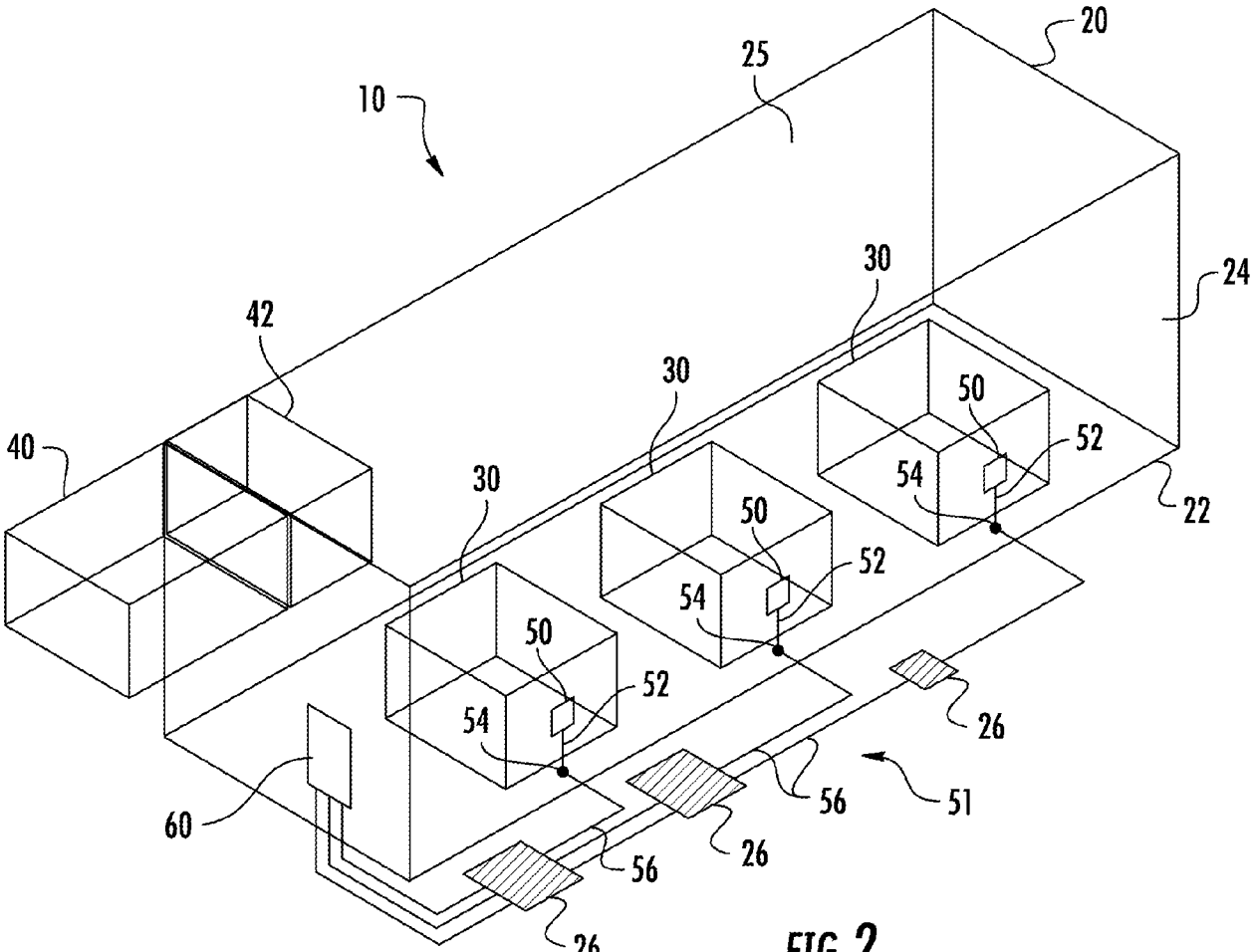
FIG. 2 illustrates a schematic view of another exemplary sensor interface in accordance with an embodiment of the invention.

Referring to FIG. 2, in an alternative embodiment, the plug terminations 54 and the embedded interface portions 56 can be disposed in or on a wall 24 of shipping container 20. In such an embodiment, temporary interface portions 52 can be associated with the plug terminations 54 located on walls 24.

Figure 3:
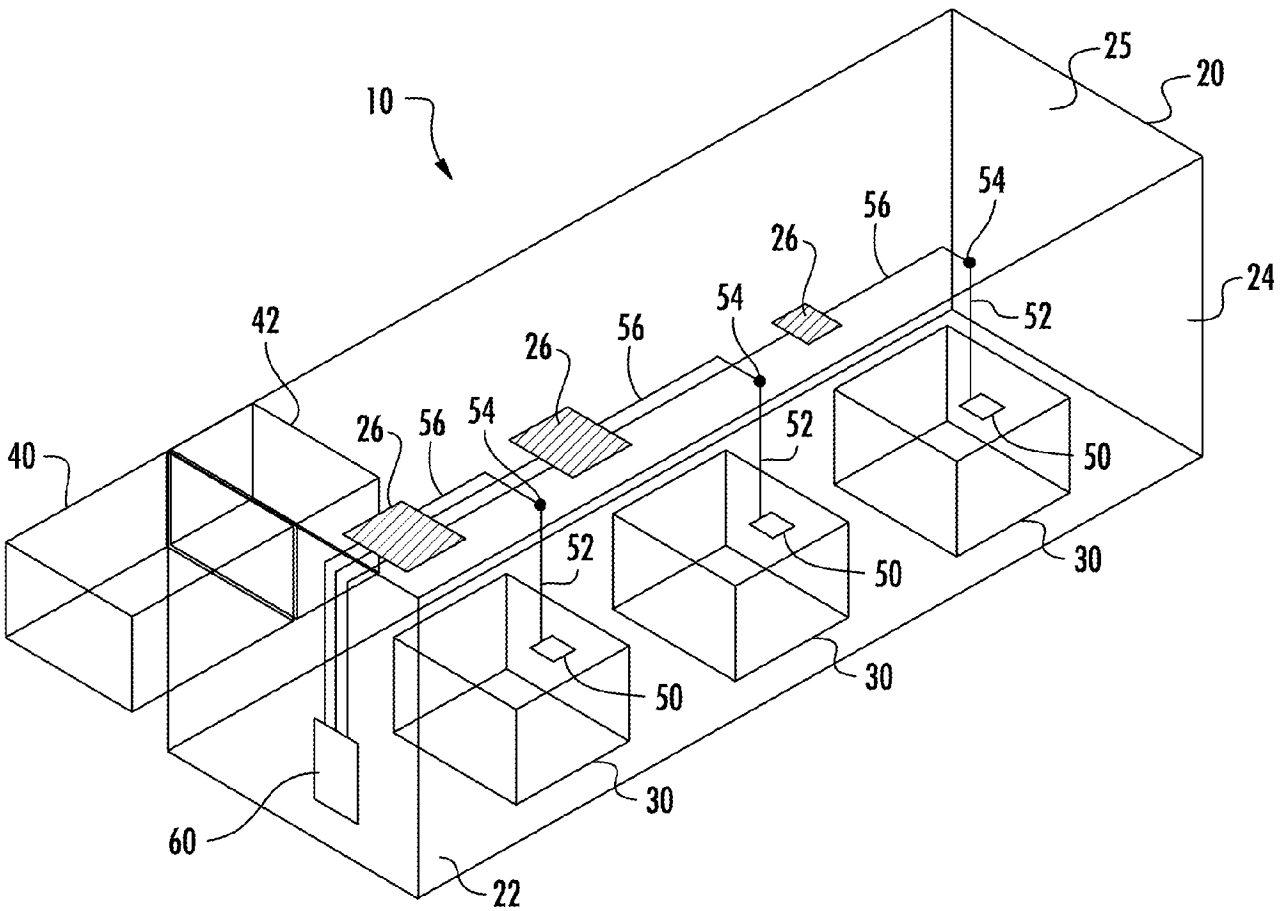
FIG. 3 illustrates a schematic view of another exemplary sensor interface in accordance with an embodiment of the invention.

Referring to FIG. 3, in an alternative embodiment, the plug terminations 54 and the embedded interface portions 56 can be disposed in or on a ceiling 25 of shipping container 20. In such an embodiment, temporary interface portions 52 can be associated with the plug terminations 54 located on the ceiling 25.

Figure 4:
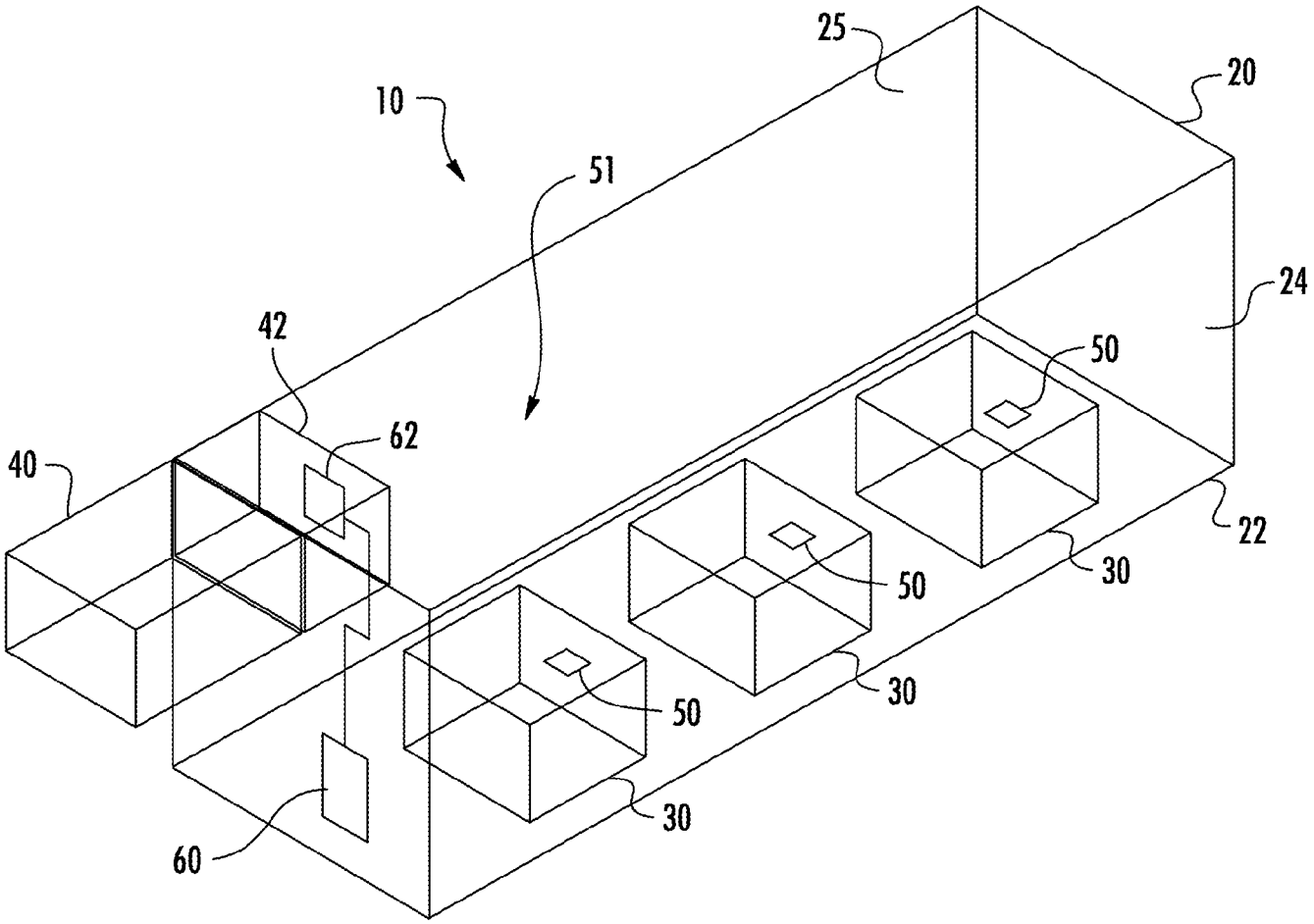
FIG. 4 illustrates a schematic view of another exemplary sensor interface in accordance with an embodiment of the invention.

Referring to FIG. 4, in an alternative embodiment, sensor interface 51 is a wireless sensor interface including wireless environmental sensors 50 and a wireless transceiver 62. In an exemplary embodiment, wireless environmental sensors 51 wirelessly communicate with the wireless transceiver 62 via any suitable wireless transmission method including, but not limited to radio frequency (RF), Bluetooth, Wi-Fi, Wi-Max, etc. Wireless transceiver 62 may be associated with controller 60 to communicate data to controller 60. In certain embodiments, wireless transceiver 62 is disposed adjacent to the evaporator 42 of air conditioning system 40 to be within the volume of shipping container 20. In other embodiments, wireless transceiver 62 is disposed within the volume of the shipping container 20, while in other embodiments, the wireless transceiver 62 is disposed in any suitable location. Advantageously, a wireless sensor interface 51 reduces setup time while reducing exposure of cables associated with environmental sensors 50 from damage.

The terminology used herein is for the purpose of describing particular embodiments only and is not intended to be limiting of the invention. While the description of the present invention has been presented for purposes of illustration and description, it is not intended to be exhaustive or limited to the invention in the form disclosed. Many modifications, variations, alterations, substitutions or equivalent arrangement not hereto described will be apparent to those of ordinary skill in the art without departing from the scope and spirit of the invention. Additionally, while the various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. An apparatus for monitoring cargo conditions, comprising:

at least one environmental sensor to monitor at least one environmental parameter associated with the cargo;

a controller to log a plurality of readings from each of the at least one environmental sensors; and a sensor interface to facilitate communication between the at least one environmental sensor and the controller;

wherein the sensor interface comprises a wired sensor interface;

wherein the sensor interface includes an embedded interface portion associated with the shipping container and a temporary interface portion associated with the at least one environmental sensor.

2. The apparatus of claim 1, wherein the sensor interface is associated with a shipping container.

3. The apparatus of claim 1, wherein the at least one environmental parameter includes at least one of a temperature, a humidity, an ethylene level, and a carbon dioxide level.

4. The apparatus of claim 1, wherein the sensor interface includes at least one plug termination associated with the embedded interface portion and the temporary interface portion.

5. The apparatus of claim 4, wherein the at least one plug termination is disposed on or in a floor or a ceiling of the shipping container.

6. The apparatus of claim 4, wherein the at least one plug termination is disposed on or in a wall of the shipping container.

7. The apparatus of claim 1, wherein the sensor interface is a wireless sensor interface and the at least one environmental sensors are wireless environmental sensors.

8. A method for monitoring cargo conditions, comprising:

providing at least one environmental sensor;

monitoring at least one environmental parameter via the at least one environmental sensor;

logging a plurality of readings from each of the at least one environmental sensors via a controller;

communicating between the at least one environmental sensor and the controller via a sensor interface;

wherein the sensor interface comprises a wired sensor interface;

wherein the sensor interface includes an embedded interface portion associated with the shipping container, a temporary interface portion associated with the at least one environmental sensor, and at least one plug termination associated with the embedded interface portion and the temporary interface portion, the at least one plug termination is disposed on or in a floor or a ceiling of the shipping container.

9. The method of claim 8, wherein the sensor interface is associated with a shipping container.

10. The method of claim 8, wherein the sensor interface includes a temporary interface portion associated with the at least one environmental sensor, and at least one plug termination associated with the embedded interface portion and the temporary interface portion, the at least one plug termination is disposed on or in a wall of the shipping container.

11. The method of claim 8, wherein the sensor interface is a wireless sensor interface and the at least one environmental sensors are wireless environmental sensors.

* * * * *